US006151925A

United States Patent [19]

Earl et al.

[11] Patent Number: 6,151,925

[45] Date of Patent: Nov. 28, 2000

[54] METHODS AND SYSTEMS FOR POSITIVELY FEEDING YARN TO CIRCULAR KNITTING MACHINES

[75] Inventors: David Earl; Wayne D. Earl, both of Lancaster, S.C.

[73] Assignee: International Machinery Sales, Inc., Lancaster, S.C.

[21] Appl. No.: 09/239,550

[22] Filed: Jan. 29, 1999

Related U.S. Application Data

[60] Provisional application No. 60/073,247, Jan. 30, 1998.

[51] Int. Cl.[7] ..... D04B 15/48

[52] U.S. Cl. ..... 66/132 T; 474/50; 242/365.7; 242/366.1

[58] Field of Search ..... 66/132 R, 132 T; 474/50; 242/365.7, 366.1

[56] References Cited

U.S. PATENT DOCUMENTS

| | | | |
|---|---|---|---|
| 3,243,091 | 3/1966 | Rosen | 226/188 |
| 3,264,845 | 8/1966 | Rosen | 66/132 |
| 3,363,815 | 1/1968 | Vostal | 226/172 |
| 3,523,433 | 8/1970 | Hatay | 66/132 T |
| 3,575,018 | 4/1971 | Levin | 66/132 |
| 4,015,447 | 4/1977 | Philip | 66/132 R |
| 4,027,505 | 6/1977 | Mishcon et al. | 66/125 |
| 4,138,866 | 2/1979 | Fecker et al. | 66/132 R |
| 4,194,375 | 3/1980 | Marchisio | 66/132 T |
| 4,328,685 | 5/1982 | Smith et al. | 66/125 R |
| 4,489,573 | 12/1984 | Engelfried et al. | 66/8 |
| 4,625,528 | 12/1986 | Guell | 66/132 T |
| 4,720,985 | 1/1988 | Goller et al. | 66/146 |
| 4,736,601 | 4/1988 | Jacobson | 66/132 R |
| 4,764,875 | 8/1988 | Carrotte et al. | 66/132 T |
| 4,969,339 | 11/1990 | Vincoli | 66/132 R |

*Primary Examiner*—Andy Falik
*Attorney, Agent, or Firm*—Jenkins & Wilson, P.A.

[57] ABSTRACT

A method for positively feeding yarn to a circular knitting machine includes adjusting a variable drive mechanism to vary the rate at which yarn is positively fed from a plurality of positive feed units to a circular knitting machine while the machine is operating. Because the positive yarn feed rate is adjustable while the circular knitting machine is operating, the time and labor required to produce knitted products is reduced. The positive yarn feed rate and the yarn tension of a circular knitting machine can be adjusted while the machine is operating. A controller coupled to the variable drive mechanism and the central stitch cam adjustment adjusts the positive yarn feed rate and the yarn tension.

32 Claims, 5 Drawing Sheets

METHODS AND SYSTEMS FOR POSITIVELY FEEDING YARN TO CIRCULAR KNITTING MACHINES

The application claims the benefit of U.S. Provisional Patent Application No. 60/073,247, filed Jan. 30, 1998, the disclosure of which is incorporated by reference herein in its entirety.

TECHNICAL FIELD

The present invention relates to methods and systems for positively feeding yarn to circular knitting machines. More particularly, the present invention relates to methods and systems for varying the rate at which yarn is positively fed to circular knitting machines while the machines are operating.

BACKGROUND OF THE INVENTION

Circular knitting machines are used in the knitting industry to knit various fabrics, e.g., single-knit jersey cloth and double-knit jersey cloth. In order to knit a fabric utilizing a circular knitting machine, a plurality of ends of yarn are supplied to a plurality of needles cylindrically disposed around the cylinder of the circular knitting machine. A plurality of stitch cams disposed around the cylinder define the travel path of the needles. The needles demand a certain quantity of yarn per revolution of the knitting machine when the machine is operating according to the stitch cam settings of the knitting machine.

The amount of yarn that is fed to the needles of a circular knitting machine determines the quality of the fabric being knitted. For example, if it is desired to knit a denser fabric, the amount of yarn fed to the needles per revolution of the knitting machine is decreased, thereby increasing yarn tension, and making smaller stitches. If it is desired to knit a less dense fabric, the amount of yarn fed to the needles per revolution of the knitting machine is increased, thereby decreasing yarn tension, and increasing the size of the stitches. Thus, in order to control the quality of a fabric, it is desirable to control the rate at which yarn is fed to a circular knitting machine.

Before the advent of positive yarn feed systems, the needles drew yarn directly from spools. This arrangement was undesirable for a variety of reasons. For example, the feed rate and tension of yarn from different spools varied due to the relative spatial locations of the spools with respect to the circular knitting machine. The varying yarn tensions and feed rates resulted in decreased product quality and increased production time.

In order to solve the problems of non-uniform feed rates, positive yarn feed systems have been developed. In positive yarn feed systems, the rate at which yarn is fed to the needles is controlled by the rate of rotation of a plurality of positive feed units, usually driven by a motor, rather than by the needles. More specifically, the plurality of positive feed units are coupled to the motor through a belt and a quality wheel. The positive feed units rotate to extract yarn from the spools and deliver yarn to the needles. Yarn is positively fed from the positive feed units to the needles only when the positive feed units are rotating. The quality wheel is adjustable to vary the rate of rotation of the positive feed units, and consequently, the rate at which yarn is fed to the needles.

A problem with conventional positive yarn feed systems is that the quality wheel cannot be adjusted while the knitting machine is operating. A conventional quality wheel is illustrated in FIGS. 1*a* and 1*b*. The quality wheel comprises upper and lower plates 102 and 104 with a plurality of movable segments 106 between the upper and lower plates. The upper plate includes a helical groove 108, while the lower plate includes radial grooves 110. A lock nut 112 connects the upper and lower plates. A belt (not shown) is positioned around the outer diameter formed by the segments between the upper and lower plates and around pulleys on each of the positive feed units (not shown). Consequently, when the quality wheel rotates, the positive feed units rotate. The diameter formed by the segments of the quality wheel controls the rate of rotation of the positive feed units.

In order to adjust a conventional quality wheel to vary the yarn feed rate, a technician must turn the knitting machine off, and loosen the lock nut 112 of the quality wheel with a wrench. Adjusting the quality wheel may require a ladder, depending on the type of knitting machine being used. After the lock nut is loosened, the technician rotates the upper plate of the quality wheel relative to the lower plate. The helical groove in the upper plate causes the segments to move radially inward or outward in the radial grooves in the lower plate, according to the direction of rotation. If the technician desires to increase the yarn feed rate, the technician moves the segments radially outward. If the technician desires to decrease the yarn feed rate, the technician moves the segments radially inward. After the technician sets the segments to the desired diameter, the technician tightens the lock nut and restarts the knitting machine. The technician measures the yarn feed rate to determine whether the yarn feed rate is properly set. If the rate is incorrectly set, the technician must repeat the above-described process to readjust the quality wheel until the desired yarn feed rate is achieved.

Conventional methods of varying the yarn feed rate are undesirable for a variety of reasons. For example, because the knitting machine must be stopped to adjust the quality wheel, production stops during adjustment. In addition, stopping and starting the machine to adjust the quality wheel strains mechanical parts and decreases knitting machine life. Further, adjusting the quality wheel requires a skilled technician. For example, it may take a technician with a year or more of training one hour or more to adjust the yarn feed rate of a circular knitting machine. Accordingly, there exists a need in the industry for a method and system for adjusting the rate at which yarn is positively fed to the needles of a circular knitting machine that avoids the difficulties associated with conventional yarn feed rate adjustment methods.

SUMMARY OF THE INVENTION

It is an object of the invention to provide a method for adjusting the rate at which yarn is positively fed to a circular knitting machine that avoids the problems associated with conventional positive yarn feed adjustment methods.

It is another object of the present invention to provide a method for varying the rate at which yarn is positively fed to a circular knitting machine while the knitting machine is operating.

It is yet another object of the present invention to provide an automated system for adjusting the rate at which yarn is positively fed to a circular knitting machine while the knitting machine is operating.

It is yet another object of the present invention to control both the rate at which yarn is positively fed to a circular knitting machine and the amount of yarn demanded by the needles of a circular knitting machine while the knitting machine is operating.

It is yet another object of the present invention to provide a yarn feed system capable of maintaining a desired yarn tension while the knitting machine is operating.

According to a first aspect of the present invention, a method for feeding yarn to a circular knitting machine includes activating a circular knitting machine to knit a product. While the circular knitting machine is operating, the rate for positively feeding yarn from a plurality of positive feed units to the circular knitting machine is varied.

According to another aspect, the present invention includes a system for positively feeding yarn to a circular knitting machine. The system includes a variable drive mechanism for varying the rate for positively feeding yarn from a plurality of positive feed units to a circular knitting machine while the circular knitting machine is operating. A first sensor senses the rate for feeding yarn from at least one of the plurality of feed units to the circular knitting machine.

According to yet another aspect, the present invention includes a knitting system. The knitting system includes a circular knitting machine. A plurality of positive feed units positively feed yarn to the circular knitting machine. A variable drive mechanism coupled to the circular knitting machine and the plurality of positive feed units varies the rate for positively feeding yarn from the plurality of positive feed units to the circular knitting machine while the circular knitting machine is operating.

DETAILED DESCRIPTION OF THE PREFERRED EMBODIMENTS

Figure 2:
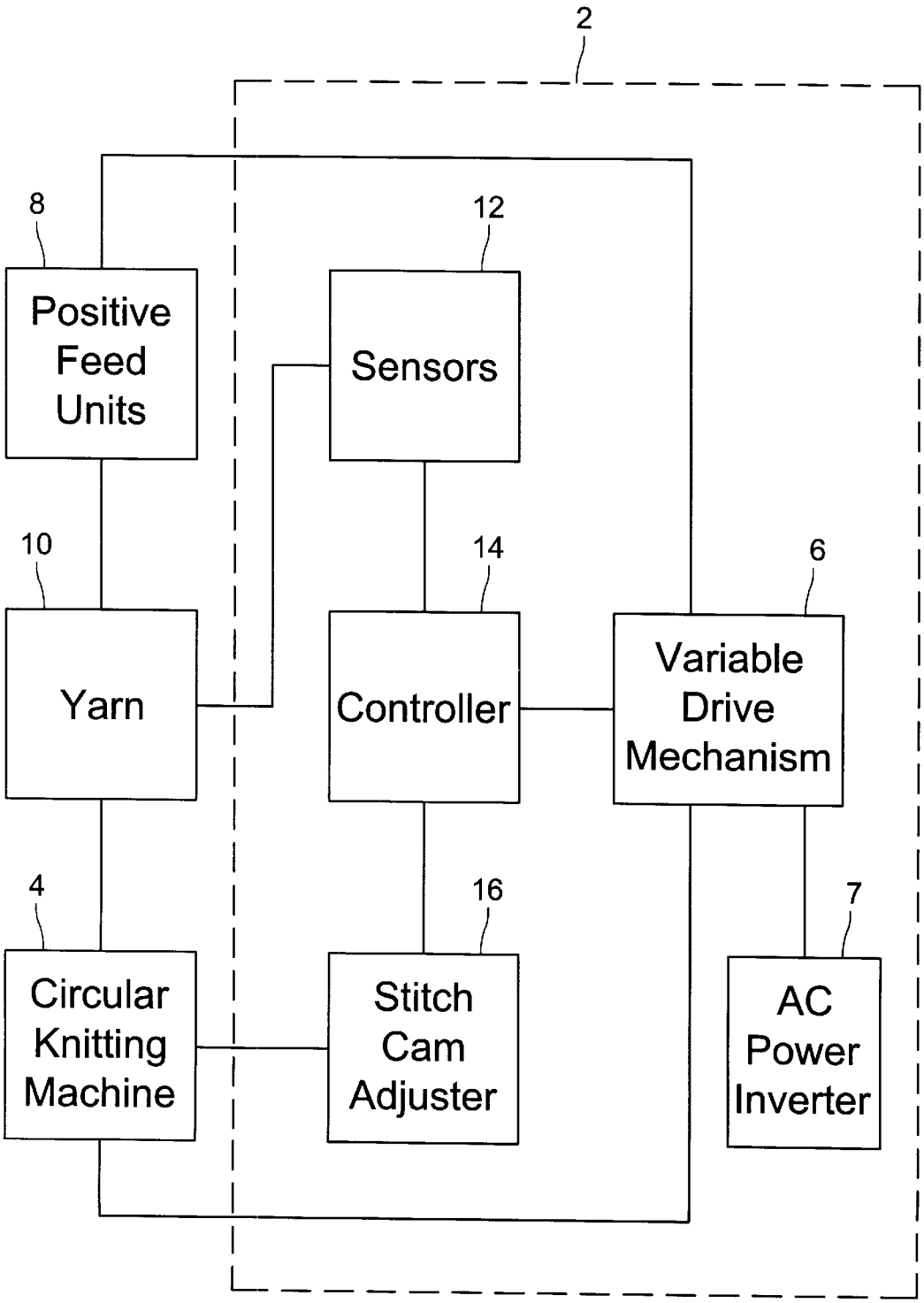
FIG. 2 is a block diagram of a system for positively feeding yarn to a circular knitting machine according to embodiments of the present invention.

FIG. 2 is a block diagram of a system 2 for positively feeding yarn to a circular knitting machine 4 according to embodiments of the present invention. The system 2 is capable of varying the rate at which yarn 10 is positively fed to the circular knitting machine 4 while the knitting machine is operating. The system 2 may be variously configured. For example, in the illustrated embodiment, the system 2 includes a variable drive mechanism 6 coupled to the circular knitting machine 4, one or more sensors 12, and a controller 14. The variable drive mechanism 6, the sensors 12, and the controller 14 cooperate to control the rate at which yarn 10 is positively fed from a plurality of positive feed units 8 to the circular knitting machine 4. The system 2 may also include a stitch cam adjuster 16 for adjusting the stitch cams of the circular knitting machine while the machine is operating.

The variable drive mechanism 6 may comprise any device for varying the rate at which the positive feed units 8 feed yarn 10 to the circular knitting machine 4 while the circular knitting machine 4 is operating. For example, the variable drive mechanism 6 may comprise a gear box with a variable gear ratio including an input shaft and an output shaft. The input shaft may be coupled to the main drive of the circular knitting machine 4 through an arrangement of shafts, pulleys, belts and/or gears. The output shaft may be similarly coupled to the positive feed units to vary the rate at which the positive feed units deliver yarn to the circular knitting machine 4. The rate of rotation of the input shaft with respect to the output shaft is adjustable while the variable drive mechanism 6 is rotating.

In a preferred embodiment, the variable drive mechanism 6 comprises a Disco variable speed drive available from Lenze Power Transmission of Fairfield, N.J. Prior to the present invention, Disco variable speed drives were used primarily as speed reducers in industrial applications, such as mixers and slicing machines. Using a Disco variable speed drive is preferred because it was discovered that the drive repeatedly maintains the yarn tension within a range suitable for knitting. For example, the variable speed drive was coupled to a circular knitting machine configured to produce single-knit jersey cloth. In this application, the variable drive mechanism caused negligible fluctuation in the yarn tension during operation of the circular knitting machine. The particular model number of the Disco drive used according to a preferred embodiment of the invention depends on the size of the knitting machine and the area for mounting the drive to the knitting machine.

The present invention is not limited to using Disco variable speed drives to adjust the yarn feed rate. Any mechanical, electrical, or electro-mechanical device capable of varying the rate at which the positive feed units deliver yarn to the circular knitting machine while the circular knitting machine is operating is within the scope of the invention. Any such device is preferably capable of maintaining the yarn tension within a predetermined range during knitting and is preferably also capable of starting and stopping in synchronism with the circular knitting machine, as will be further discussed below. For example, according to an alternative embodiment of the invention, the variable drive mechanism may comprise an electric motor, such as a synchronous AC motor. Because the starting or stopping of an AC motor depends on the phase of the power being supplied to the AC motor, the phase is preferably controlled so that the AC motor starts and stops at the same time as the circular knitting machine. One or more AC power inverters 7 may be required to achieve synchronous operation with the circular knitting machine.

Figure 3A:
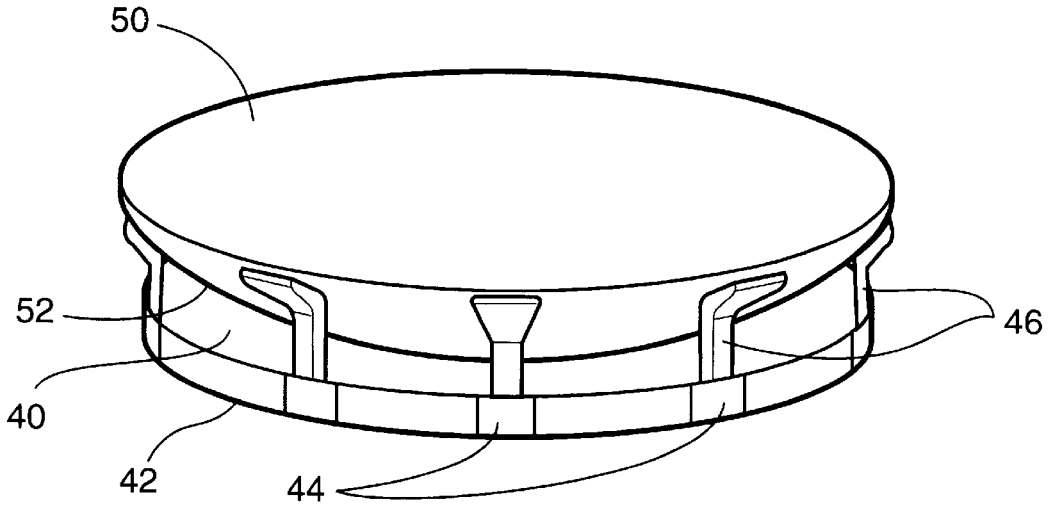
FIGS. 3*a* and 3*b* are perspective views of an adjustable quality wheel according to an embodiment of the present invention.
Figure 3B:
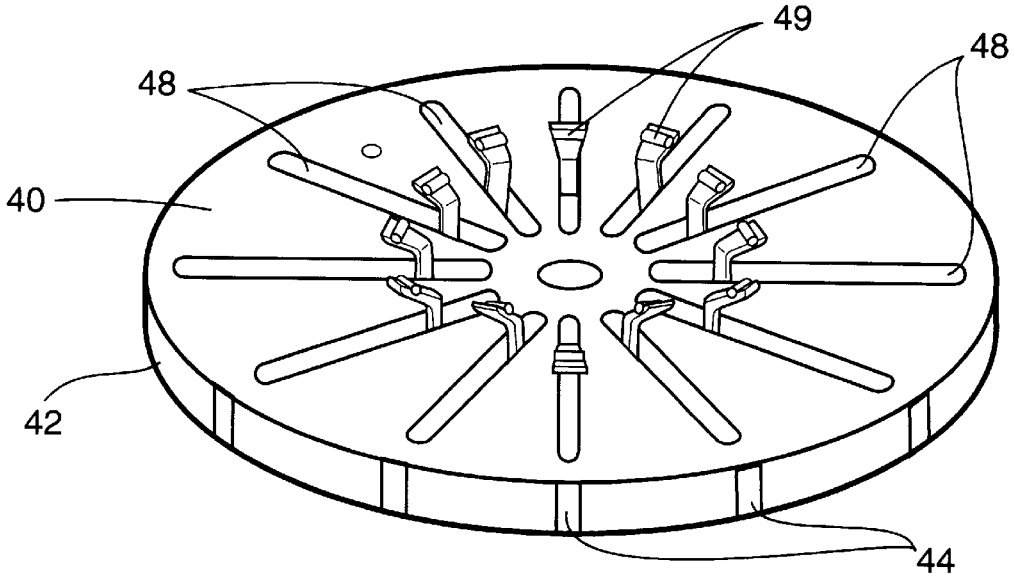
Figure 3C:
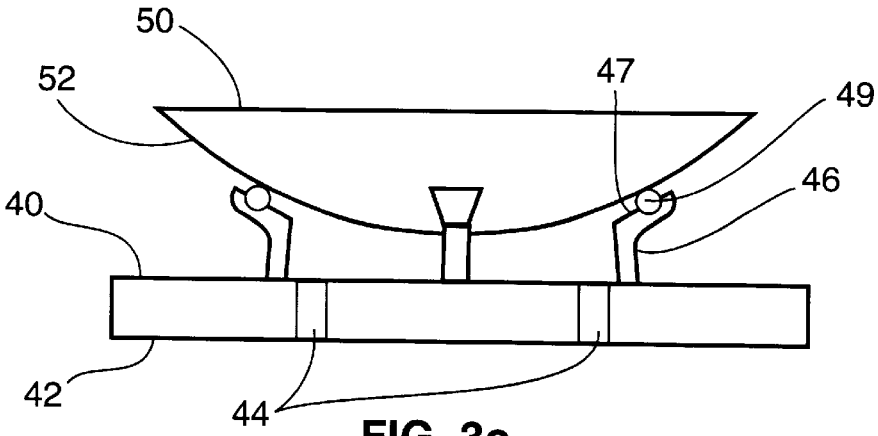
FIG. 3*c* is a front view of an adjustable quality wheel according to the embodiment of FIGS. 3*a* and 3*b*.

In still another alternative embodiment, the variable drive mechanism may comprise a quality wheel in which the outer diameter is adjustable while the knitting machine is operating. FIGS. 3*a*–3*c* illustrate an adjustable quality wheel according to an embodiment of the present invention. In the illustrated embodiment, the quality wheel comprises upper and lower plates 40, 42 and movable segments 44 between the upper and lower plates. The segments 44 are preferably each biased to move towards the center axis of the quality wheel, for example, using a radially extending spring (not shown) attached to each segment 44.

The segments 44 may include axial protrusions 46 that extend through either the upper plate 40 or the lower plate 42 in a direction parallel to the axis of rotation of the quality wheel. As best illustrated in FIG. 3*c*, the axial protrusions 46 each include angled upper surfaces 47. In a preferred embodiment, the angled upper surfaces 47 each include a bearing 49, such as a roller bearing.

The upper plate 40 or the lower plate 42 may include radial channels to guide the segments 44 radially inward or outward. In the illustrated embodiment, the axial protrusions 46 extend through radial channels 48 in the upper plate 40. A control plate 50 having a convex lower 52 surface may be movably mounted above or below the quality wheel.

In operation, in order to increase the diameter of the quality wheel, the control plate 50 may move towards the quality wheel. The convex lower surface 52 of the control plate 50 contacts the bearings 49 on the angled upper surfaces 47 of the protrusions 46 and moves the segments 44 radially outward as the control plate 50 moves towards the quality wheel. In order to decrease the diameter of the quality wheel, the control plate 50 moves away from the quality wheel, allowing the springs to move the segments 44 radially inward. In such an embodiment, the system preferably includes a belt tensioner to maintain a desired belt tension of the belt around the quality wheel when the diameter of the quality wheel decreases.

The present invention is not limited to using a control plate to adjust the diameter of the quality wheel. Any method of adjusting the diameter of the quality wheel while the quality wheel is rotating is within the scope of the invention. For example, radial movement of the segments may be controlled by a servomotor associated with the quality wheel.

Referring back to FIG. 2, the system 2 for feeding yarn into a circular knitting machine may also include one or more sensors 12 for sensing yarn feed rate and/or yarn tension. For example, the sensors 12 may include a feed rate gauge and a tension gauge coupled to one or more yarns being fed to the circular knitting machine. Alternatively, the sensor 12 may sense a belt speed associated with a belt for controlling a plurality of positive feed units that feed yarn to the circular knitting machine. The sensor may be calibrated to determine the positive feed based on the belt speed. The sensors 12 may provide analog outputs, digital outputs, or analog and digital outputs indicative of yarn feed rate and/or yarn tension.

In order to communicate the sensor output information to an operator, the system 2 may include a display 13 for displaying operating information to an operator. The display may be an analog display or a digital display. For example, the display 13 may be an LED display, a liquid crystal display, a CRT display, or needle-type display. Any type of display is within the scope of the invention. The display 13 may display the yarn feed rate and/or yarn tension in any appropriate units, e.g., inches per revolution or inches per unit time for the feed rate and grams for tension.

The sensor output signals may be used to automatically adjust the rate at which yarn is fed to the knitting machine. Alternatively, the display may simply display the yarn feed rate to an operator, and the operator may manually adjust the variable drive mechanism 6 until the displayed yarn feed rate is equal to the desired yarn feed rate. In addition, in embodiments that include a yarn tension gauge, the output from the sensors 12 may be used to adjust the stitch cams, as will be discussed below.

In embodiments in which the output signals from the sensors 12 are used to automatically adjust the variable drive mechanism 6, the system 2 preferably includes a controller 14 for controlling the variable drive mechanism 6. The controller 14 may comprise any arrangement of electrical for electromechanical components for adjusting the variable drive mechanism 6. For example, the controller 14 may comprise a motor controlled by a microprocessor to adjust the variable drive mechanism based on the yarn feed rate measured by the sensors 12. In industrial applications in which a plurality of knitting machines include variable drive mechanisms 6 and sensors 12, a central computer may monitor and control the rate at which yarn is fed to a plurality of the knitting machines. Thus, controlling a plurality of systems 2 using software is within the scope of the invention.

The controller 14 may also automatically adjust the stitch cams to set the yarn tension to a desired value. In circular knitting machines without central stitch cam adjustment, the system 2 may include a stitch cam adjuster 16 for adjusting the stitch cams. The stitch cam adjuster 16 may comprise a plurality of servomotors, e.g., one motor associated with each cam box of the knitting machine to increase or decrease the travel distance of the needles. For example, each stitch cam may be raised or lowered one of the motors to set the yarn tension to a desired value.

In the case of plain circular knitting machines, e.g., fleece, jersey, etc., where centralized stitch cam adjustment is incorporated, a cam box support plate may be moved up or down by a single adjuster. Since all of the stitch cams are connected to the cam box support plate, the tension of all of the yarns can be simultaneously adjusted at a single location. Alternatively, in some conventional circular knitting machines, the cylinder may be moved up or down to adjust all of the stitch cams. In either type of circular knitting machine, stitch cam adjustment is preferably linked to the variable drive mechanism 6 through electromechanical means. That is, the stitch cam adjuster 16 may be incorporated in the circular knitting machine and the controller 14 may adjust the stitch cams, e.g., by moving the cam box support plate or the cylinder to set the yarn tension when the yarn feed rate changes.

In conventional knitting machines, there was no motivation to link control of the stitch cams to control of the positive feed rate because adjustment of the positive feed rate required that the knitting machine be turned off. Since embodiments of the present invention adjust the positive feed rate while the circular knitting machine is operating, the knitting capabilities of a knitting machine are further enhanced. For example, during knitting, if it is desired to increase the yarn feed rate to a certain value, an operator first adjusts the variable drive mechanism to increase the feed rate. However, it may not be possible to reach the desired feed rate because the yarn tension becomes too low, i.e., yarn is being fed to the needles faster than they are knitting. Since the controller 14 may automatically adjust the stitch cams, e.g., by moving the central stitch cam adjustment mechanism, the yarn tension may be increased so that the yarn feed rate may be further increased. Thus, embodiments of the present including automatic stitch cam adjustment increase the range over which the positive feed rate can be adjusted during knitting.

Figure 4:
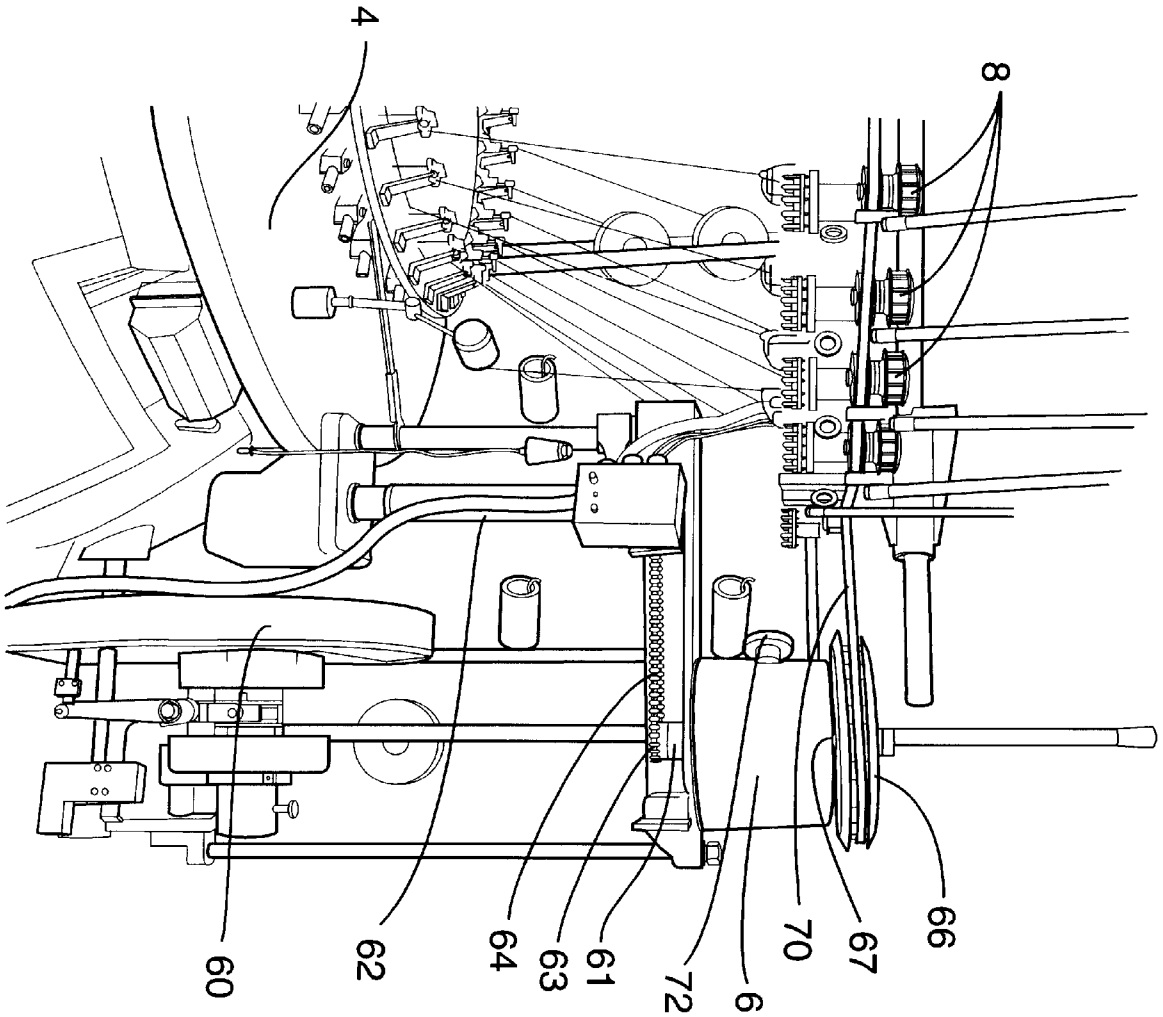
FIG. 4 is a perspective view of a knitting system including a system for positively feeding yarn to a circular knitting machine according to an embodiment of the present invention.

According to another aspect of the invention, a knitting system may comprise some or all of the elements of the system 2, the circular knitting machine 4, and the plurality of positive feed units 8. FIG. 4 is a perspective view of a knitting system according to an embodiment of the present invention. In the illustrated embodiment, the variable drive mechanism 6 comprises a Disco drive, the operation of which is described above. The variable drive mechanism 6 is coupled to the main drive 60 of the circular knitting machine 4. More specifically, the input shaft 61 of the variable drive mechanism 6 is rotatably coupled to a second shaft 62, which is rotatably coupled to the main drive 60. A timing chain 64 is coupled to a gear 63 on the input shaft 61 of the variable drive mechanism 6 and to a gear (not shown) on the second shaft 62. The timing chain 64 and the gears ensure synchronous operation between the variable drive mechanism 6 and the knitting machine 4.

Figure 1A:
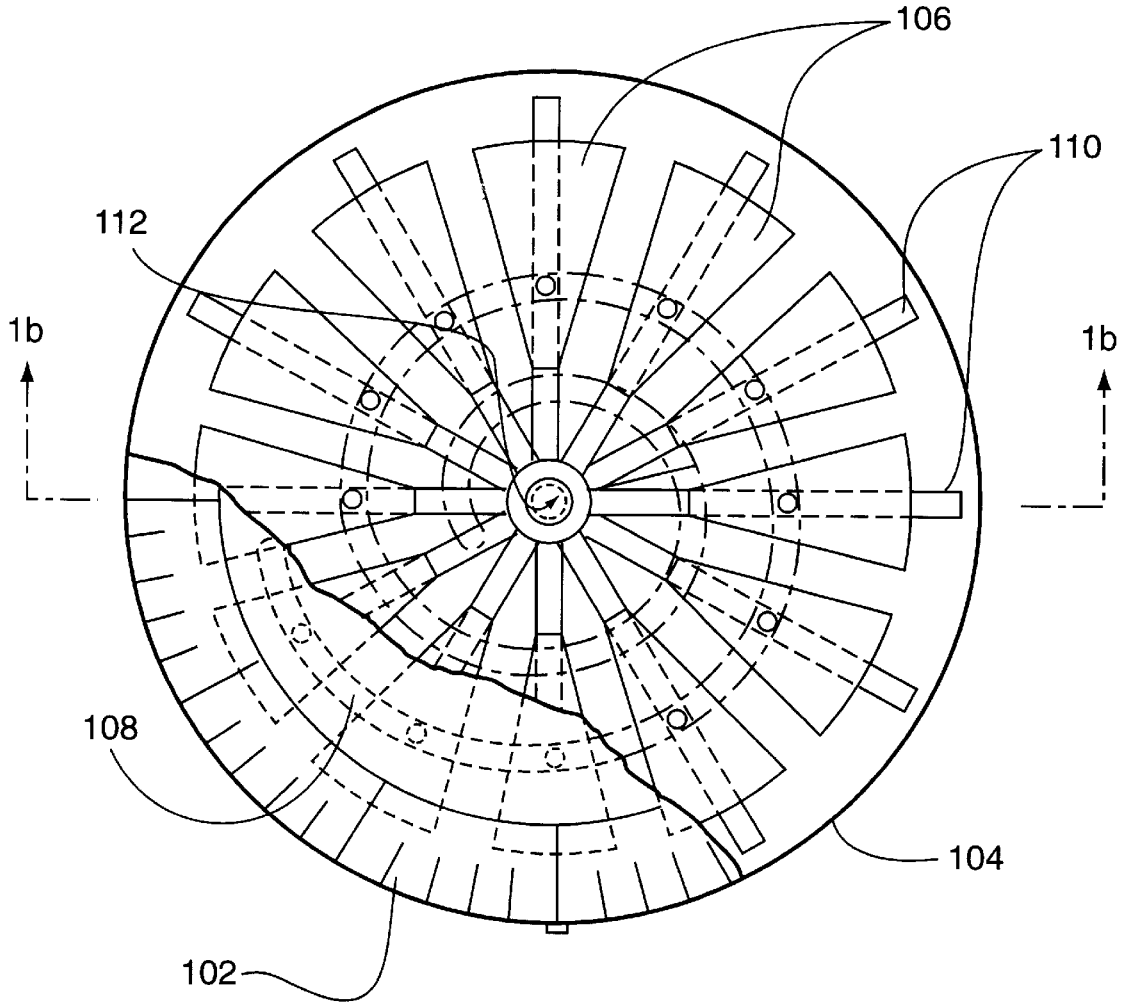
FIG. 1a (Prior Art)
FIG. 1*a* is a sectional top view of a conventional quality wheel.
Figure 1B:
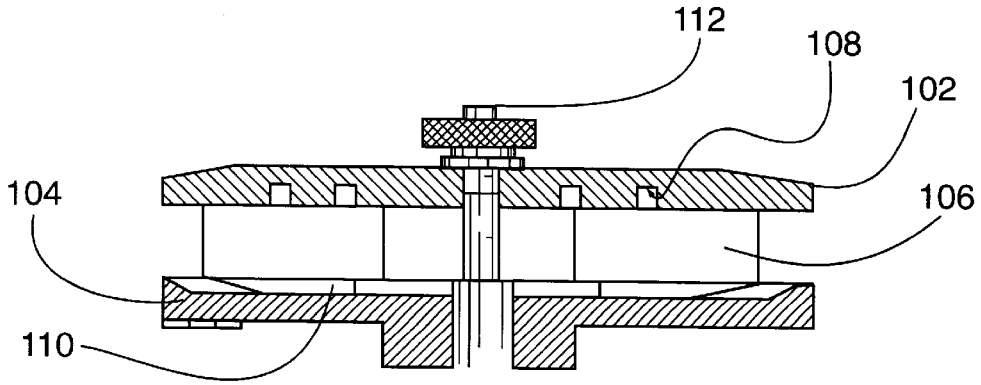
FIG. 1b (Prior Art)
FIG. 1*b* is a sectional side view of the quality wheel illustrated in FIG. 1*a*.

A pulley 66 is mounted to an output shaft 67 of the variable drive mechanism 6. The pulley 66 is preferably sized to allow adjustment of the positive feed system over a desired range of yarn demand of the knitting machine 4. In the illustrated embodiment, the pulley 66 comprises a quality wheel, for example, as illustrated in FIGS. 1*a* and 1*b*. However, since the yarn feed rate can be adjusted without changing the diameter of the quality wheel, a fixed pulley of the desired diameter is preferred.

A belt 70 couples the pulley 66 to the plurality of positive feed units 8. The belt preferably includes a ridged inner surface corresponding to ridges in the pulley 66 and the positive feed units 8 to prevent slipping. A belt tensioner (not shown) may be used to maintain a desired belt tension.

The variable drive mechanism includes a dial 72 to vary the rate of rotation of the output shaft 67 with respect to the input shaft 61 of the variable drive mechanism 6. Any method of adjusting the dial 72 to vary the yarn feed rate is within the scope of the invention. For example, the dial may be adjusted automatically, e.g. using a servomotor, a controller, and a sensor, as illustrated in FIG. 2. Alternatively, the dial 72 may be adjusted manually, e.g., by an operator operating the circular knitting machine 4.

The plurality of positive feed units 8 comprise any type of units capable of positively feeding yarn to the knitting machine 4. In the illustrated embodiment, the plurality of positive feed units 8 each comprise a drum-type positive feed unit. Exemplary positive feed units suitable for use with the present invention are described in U.S. Pat. No. 4,138,866, issued Feb. 13, 1979, the disclosure of which is incorporated herein by reference.

The knitting machine 4 may comprise any type of circular knitting machine. For example, the knitting machine may comprise a single-knit circular knitting machine or a dial-type circular knitting machine. In embodiments in which the knitting machine comprises a dial-type circular knitting machine, a plurality of variable drive mechanisms 6 may drive a plurality of levels of positive feed units 8. In the illustrated embodiment, the knitting machine comprises a single-knit circular knitting machine.

Figure 5:
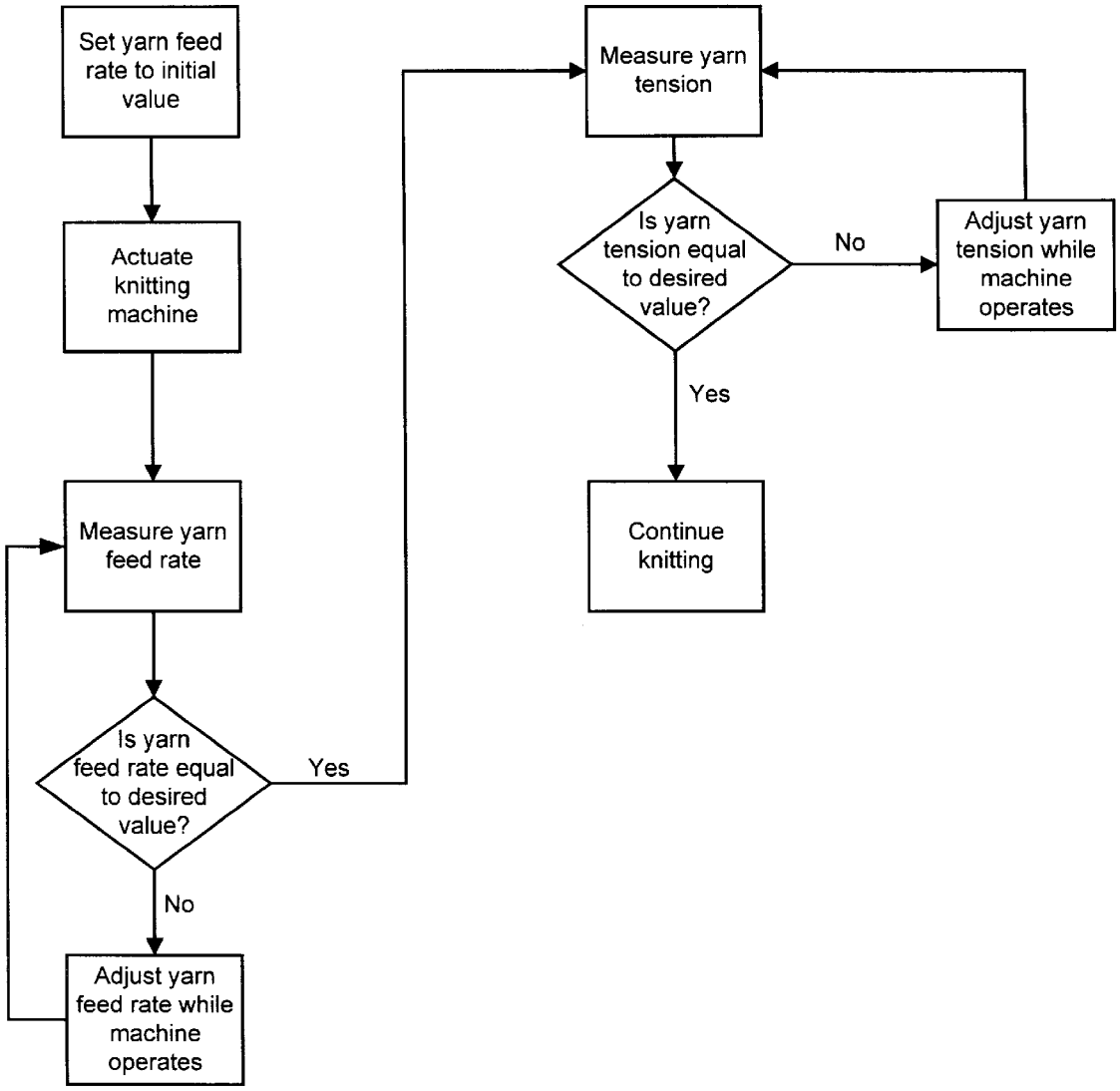
FIG. 5 is a flow chart of a method for positively feeding yarn to a circular knitting machine according to an embodiment of the present invention.

An important aspect of the present invention includes a method for feeding yarn to a circular knitting machine. FIG. 5 illustrates a method for feeding yarn to a circular knitting machine. In order to set the knitting machine 4 to knit a product, an operator first sets variable drive mechanism to an initial value to allow the knitting machine to operate. The operator then actuates the circular knitting machine. Next, the operator measures the yarn feed rate and adjusts the feed rate to a desired feed rate according to the quality specified for a fabric. If the rate is not equal to the desired rate, the operator simply adjusts the yarn feed rate, e.g., by rotating the dial of the variable drive mechanism 6 while the circular knitting machine is operating. As discussed above, conventional adjustment methods required deactuation of the knitting machine and manual adjustment of the quality wheel. Since the present method can be performed while the knitting machine is operating, considerable time is saved over conventional methods. In addition, a skilled technician is no longer required to adjust the feed rate. According to methods of the present invention, an unskilled laborer can be trained in as little as a few hours to control the feed rate of a knitting machine. Thus, knitting methods of the present invention represent a significant advance in the knitting industry.

The operator may also adjust the yarn tension to the desired value by adjusting the stitch cams while or after adjusting the yarn feed rate. As discussed above, it is within the scope of the invention that this adjustment be performed automatically by a controller coupled to the variable drive mechanism and the central stitch cam adjustment mechanism of the circular knitting machine. Alternatively, in machines without central stitch cam adjustment, a servomotor associated with each stitch cam may perform the adjustment. As discussed above, adjusting the stitch cams during knitting increases the range over which the variable mechanism can adjust the positive feed rate. As a result, changes in quality and/or fabric can be effected without deactuating the knitting machine.

While the invention has been described in some detail by way of illustration and example, it should be understood that the invention is susceptible to various modifications and alternative forms, and is not restricted to the specific embodiments set forth. It should be understood that these specific embodiments are not intended to limit the invention but, on the contrary, the intention is to cover all modifications, equivalents, and alternatives falling within the spirit and scope of the invention.

What is claimed is:

1. A method for feeding yarn to a circular knitting machine comprising:

(a) activating a circular knitting machine to knit a product;

(b) driving an input shaft of a variable drive mechanism using a main drive of the circular knitting machine;

(c) driving an output shaft of the variable drive mechanism using the input shaft;

(d) driving a plurality of positive feed units for feeding yarn to the circular knitting machine with the output shaft;

(e) feeding the yarn from the plurality of positive feed units at a uniform rate relative to each other; and (f) while the circular knitting machine is operating, varying, from a single location, the rate for positively feeding yarn from the plurality of positive feed units to the circular knitting machine by adjusting the rate of rotation of the input shaft with respect to the output shaft.

2. A method for feeding yarn to a circular knitting machine comprising:

(a) activating a circular knitting machine to knit a product;

(b) driving an input shaft of a variable drive mechanism using a main drive of the circular knitting machine;

(c) driving an output shaft of the variable drive mechanism using the input shaft;

(d) driving a plurality of positive feed units for feeding yarn to the circular knitting machine with the output shaft;

(e) while the circular knitting machine is operating, varying a rate for positively feeding yarn from the plurality of positive feed units to the circular knitting machine by adjusting a rate of rotation of the input shaft with respect to the output shaft;

(f) sensing a tension of at least once of a plurality of yarns being fed to the circular knitting machine to produce a second output signal; and (g) adjusting the yarn tension in accordance with the second output signal.

3. The method of claim 1 wherein driving an input shaft of a variable drive mechanism comprises coupling the input shaft to the main drive of the circular knitting machine using at least one gear and a timing chain.

4. The method of claim 1 wherein driving a plurality of positive feed units with the output shaft comprises coupling the plurality of positive feed units to the output shaft using a pulley and a belt.

5. The method of claim 1 wherein adjusting a rate of rotation of the input shaft with respect to the output shaft comprises varying a gear ratio that controls the rate of rotation of the input shaft with respect to the output shaft.

6. The method of claim 5 wherein varying the gear ratio includes rotating a mechanical adjuster associated with the variable drive mechanism.

7. A method for feeding yarn to a circular knitting machine comprising:

(a) activating a circular knitting machine to knit a product; and (b) while the circular knitting machine is operating, varying a rate for positively feeding yarn from a plurality of positive feed units to the circular knitting machine, wherein varying the rate for positively feeding yarn from the positive feed units includes adjusting the diameter of a quality wheel operatively associated with the positive feed units while the quality wheel is rotating.

8. The method of claim 1 comprising:

sensing the rate for positively feeding yarn from the plurality of positive feed units to the circular knitting machine to produce an output signal, and wherein varying the rate for positively feeding yarn from the plurality of positive feed unit comprises varying the rate in accordance with the output signal.

9. A system for positively feeding yarn to a circular knitting machine comprising:

(a) a variable drive mechanism for varying a rate for positively feeding yarn from a plurality of positive feed units to a circular knitting machine while the circular knitting machine is operating, the variable drive mechanism comprising:

(i) an input shaft;

(ii) means for coupling the input shaft to a main drive of the circular knitting machine;

(iii) an output shaft;

(iv) means for coupling the output shaft to the plurality of positive feed units; and (v) a mechanical adjuster for varying a rate of rotation of the input shaft with respect to the output shaft while the circular knitting machine is rotating; and (b) a first sensor for sensing the rate for positively feeding yarn from at least one of the plurality of positive feed units to the circular knitting machine and producing a first output signal indicative of the rate.

10. The system of claim 9 comprising:

a controller coupled to the first sensor and the variable drive mechanism for adjusting the rate for positively feeding yarn from the plurality of positive feed units to the circular knitting machine based on the first output signal.

11. The system of claim 9 comprising a second sensor for sensing a yarn tension of at least one yarn being fed to the circular knitting machine and producing a second output signal.

12. The system of claim 11 comprising a controller coupled to the second sensor and the variable drive mechanism for adjusting the rate for positively feeding yarn from the plurality of positive feed units to the circular knitting machine and for adjusting the yarn tension.

13. The system of claim 9 comprising a display for displaying the rate for positively feeding yarn from the plurality of positive feed units to the circular knitting machine.

14. The system of claim 9 wherein the means for coupling the input shaft to the main drive of the circular knitting machine comprises a gear coupled to the input shaft and a timing chain for coupling the gear to the main drive to ensure synchronous rotation of the input shaft with the main drive.

15. The system of claim 9 wherein the means for coupling the output shaft to the plurality of positive feed units includes a pulley coupled to the output shaft and a belt for coupling the pulley to the plurality of positive feed units.

16. The system of claim 9 wherein the mechanical adjuster includes a rotatable dial adapted to vary a gear ratio for varying the rate of rotation of the input shaft with respect to the output shaft.

17. A system for positively feeding yarn to a circular knitting machine comprising:

(a) a variable drive mechanism adapted to vary a rate for positively feeding yarn from a plurality of positive feed units to a circular knitting machine while the circular knitting machine is operating, wherein the variable drive mechanism comprises a quality wheel coupled to the plurality of positive feed units and an outer diameter of the quality wheel is adjustable while the quality wheel is rotating; and (b) a first sensor for sensing the rate for positively feeding yarn from at least one of the plurality of positive feed units to the circular knitting machine and producing a first output signal indicative of the rate.

18. The system of claim 17 wherein the quality wheel includes:

(a) a first plate having a plurality of radial channels;

(b) a second plate;

(c) a plurality of segments between the first and second plates slidably disposed in the plurality of radial channels, the plurality of segments including a plurality of axial protrusions extending through the plurality of radial channels; and (d) a control plate operatively associated with the plurality of radial channels for moving the plurality segments radially while the quality wheel is rotating.

19. A knitting system comprising:

(a) a circular knitting machine;

(b) a plurality of positive feed units for positively feeding yarn to the circular knitting machine; and (c) a planetary drive coupled to the circular knitting machine and the plurality of positive feed units for varying a rate for positively feeding yarn from the plurality of positive feed units to the circular knitting machine while the circular knitting machine is operating, wherein the planetary drive comprises:

(i) an input shaft;

(ii) means for coupling the input shaft to a main drive of the circular knitting machine;

(iii) an output shaft;

(iv) means for coupling the output shaft to the plurality of positive feed units; and (v) a mechanical adjuster for varying a rate of rotation of the input shaft with respect to the output shaft while the circular knitting machine is operating.

20. The system of claim 19 comprising a first sensor for sensing the rate for positively feeding yarn from at least one of the positive feed units to the circular knitting machine.

21. The system of claim 20 comprising:

a controller coupled to the first sensor and the variable drive mechanism for adjusting the rate for positively feeding yarn from the plurality of positive feed units to the circular knitting machine.

22. The system of claim 19 wherein the means for coupling the input shaft to the main drive of the circular knitting machine comprises a gear coupled to the input shaft and a timing chain for coupling the gear to the main drive to ensure synchronous rotation of the input shaft with the main drive.

23. The system of claim 19 wherein the means for coupling the output shaft to the plurality of positive feed units includes a pulley coupled to the output shaft and a belt for coupling the pulley to the plurality of positive feed units.

24. The system of claim 19 wherein the mechanical adjuster includes a rotatable dial adapted to vary a gear ratio for varying the rate of rotation of the input shaft with respect to the output shaft.

25. A knitting system comprising:

(a) a circular knitting machine, wherein the circular knitting machine comprises:

(b) a plurality of needles;

(c) a plurality of stitch cams for guiding the needles;

(d) a central stitch cam adjustment mechanism for adjusting the plurality of stitch cams;

(e) a plurality of positive feed units for positively feeding yarn to the circular knitting machine;

(f) a variable drive mechanism coupled to the circular knitting machine and to the plurality of positive feed units for varying a rate for positively feeding yarn from the plurality of positive feed units to the circular knitting machine while the circular knitting machine is operating; and (g) a controller coupled to the variable drive mechanism and the central stitch cam adjustment mechanism to adjust the yarn tension when the rate for positively feeding yarn from the plurality of positive feed units to the circular knitting machine changes.

26. The system of claim 25 wherein the variable drive mechanism comprises an AC motor and means for stopping and starting the AC motor synchronously with the circular knitting machine.

27. The system of claim 26 wherein the means for stopping and starting comprises at least one power inverter.

28. In combination with a positive yarn feed system, a planetary drive for varying the rate for positively feeding yarn from a plurality of positive feed units to a knitting machine while the circular knitting machine is operating, the planetary drive comprising:

(a) an input shaft;

(b) means for coupling the input shaft to a main drive of the knitting machine;

(c) an output shaft;

(d) means for coupling the output shaft to the plurality of positive feed units; and (e) an adjuster for varying a rate of rotation of the input shaft with respect to the output shaft while the circular knitting machine is operating.

29. The planetary drive of claim 28 wherein the means for coupling the input shaft to the main drive of the knitting machine comprises a gear coupled to the input shaft and a timing chain for coupling the gear to the main drive to ensure synchronous rotation of the input shaft with the main drive.

30. The planetary drive of claim 28 wherein the means for coupling the output shaft to the plurality of positive feed units includes a pulley coupled to the output shaft and a belt for coupling the pulley to the plurality of positive feed units.

31. The planetary drive of claim 28 wherein the adjuster includes a rotatable dial adapted to vary a gear ratio for varying the rate of rotation of the input shaft with respect to the output shaft.

32. The method of claim 1 wherein the variable drive mechanism comprises a planetary drive.

* * * * *